US011134743B2

(12) United States Patent
Mariacher

(10) Patent No.: US 11,134,743 B2
(45) Date of Patent: Oct. 5, 2021

(54) CLIMBING SHOE

(71) Applicant: CALZATURIFICIO S.C.A.R.P.A S.p.A., Asolo (IT)

(72) Inventor: Heinz Mariacher, Asolo (IT)

(73) Assignee: CALZATURIFICIO S.C.A.R.P.A S.p.A.

( * ) Notice: Subject to any disclaimer, the term of this patent is extended or adjusted under 35 U.S.C. 154(b) by 172 days.

(21) Appl. No.: 16/419,299

(22) Filed: May 22, 2019

(65) Prior Publication Data

US 2019/0373979 A1 Dec. 12, 2019

(30) Foreign Application Priority Data

May 23, 2018 (IT) ..... 102018000005616

(51) Int. Cl.

| | |
|---|---|
| ***A43B 5/00*** | (2006.01) |
| ***A43B 23/02*** | (2006.01) |
| ***A43B 13/16*** | (2006.01) |
| ***A43B 13/04*** | (2006.01) |
| ***A43B 13/22*** | (2006.01) |

(52) U.S. Cl.

CPC ..... *A43B 5/003* (2013.01); *A43B 13/04* (2013.01); *A43B 13/16* (2013.01); *A43B 13/22* (2013.01); *A43B 23/0295* (2013.01)

(58) Field of Classification Search

CPC ..... A43B 5/003; A43B 13/16; A43B 13/22; A43B 13/04; A43B 23/0295; A43B 23/027; A43B 23/0215; A43B 23/0255

See application file for complete search history.

(56) References Cited

U.S. PATENT DOCUMENTS

2003/0015776 A1 1/2003 Recktenwald, et al.
2003/0196350 A1* 10/2003 Chu ..... A43B 3/06 36/58.5

(Continued)

FOREIGN PATENT DOCUMENTS

| | | |
|---|---|---|
| EP | 0933033 A2 | 8/1999 |
| EP | 1428444 A1 | 6/2004 |
| EP | 2274994 A1 | 1/2011 |

OTHER PUBLICATIONS

Italian Search Report—Ministero dello Sviluppo Economico IT Application No. IT2018000005616, dated May 23, 2018, pp. 1-7.

*Primary Examiner* — Ted Kavanaugh
(74) *Attorney, Agent, or Firm* — The Belles Group, P.C.

(57) ABSTRACT

A climbing shoe comprising: a shoe-upper shaped so as to accommodate and cover substantially the entire foot of the user; a front sole made of polymeric material, which is fixed to the bottom of the shoe-upper so as to cover at least the front part of the bottom of said shoe-upper; and at least a front tensioning band made of elastomeric material, which is substantially U-bent and is fixed to the tip of the shoe-upper so as to surround/enclose the front part of the bottom of the shoe-upper, joining the front sole; the front tensioning band has a ribbon-like monolithic structure and is longitudinally divided into a lower ribbon-like portion which is immediately adjacent/contiguous to the front sole, and into an upper ribbon-like portion which flanks the lower ribbon-like portion while remaining spaced from the edge of the front sole, and which has a hardness lower than that of the lower ribbon-like portion.

14 Claims, 3 Drawing Sheets

(56) References Cited

U.S. PATENT DOCUMENTS

| | | | | |
|---|---|---|---|---|
| 2004/0111921 | A1* | 6/2004 | Lenormand | A43B 5/003 36/45 |
| 2004/0244226 | A1* | 12/2004 | Farys | A43B 7/20 36/140 |
| 2005/0138848 | A1* | 6/2005 | Fullerton | A43B 13/146 36/113 |
| 2015/0342290 | A1* | 12/2015 | Mariacher | A43B 13/16 36/114 |
| 2015/0342291 | A1* | 12/2015 | Mariacher | A43B 13/16 36/114 |
| 2015/0342292 | A1* | 12/2015 | Mariacher | A43B 13/42 36/114 |
| 2017/0049186 | A1* | 2/2017 | Lee | A43B 5/003 |
| 2018/0317592 | A1* | 11/2018 | Rudolf | D04B 1/24 |
| 2019/0373979 | A1* | 12/2019 | Mariacher | A43B 5/003 |
| 2019/0373980 | A1* | 12/2019 | Mariacher | A43B 13/04 |
| 2020/0170332 | A1* | 6/2020 | Mariacher | A43B 13/04 |

* cited by examiner

CLIMBING SHOE

CROSS-REFERENCE TO RELATED APPLICATIONS

This patent application claims priority from Italian patent application no. 102018000005616 filed on May 23, 2018, the entire disclosure of which is incorporated herein by reference.

TECHNICAL FIELD

The present invention relates to a climbing shoe.

BACKGROUND ART

As is known, climbing shoes currently comprise: a leather and/or fabric shoe-upper which is substantially sock-shaped so as to accommodate and cover the foot of the user, including the sole of the foot; a front tensioning band made of high-elasticity elastomeric material, which is substantially U-bent and is fixed by gluing to the tip of the shoe-upper so as to surround the tarsus-phalangeal portion of the user's foot; a rear tensioning band made of high-elasticity elastomeric material, which is substantially U-bent and is fixed by gluing to the rear part of the shoe-upper so as to cover the region above the heel of the user's foot, and then extends along the two lateral sides of the shoe-upper up to meet and join the front tensioning band; and a sole made of soft and flexible polymeric material with a high friction coefficient and substantially inextensible, which is fixed by gluing to the bottom of the shoe-upper partially overlapping the front tensioning band and possibly also the rear one, so as to cover the whole of the sole of the user's foot.

Since it is always into contact with the rock, the front band of the climbing shoe is currently made of an elastomeric material with a hardness greater than or equal to 90 ShoreA, so as to prevent it from wearing out too quickly due to continuous friction against the rock.

Unfortunately, in some cases this structural constraint makes the front part of the climbing shoe a little too stiff, somehow reducing the capability of the user to perceive the features of the foothold on the wall.

SUBJECT-MATTER OF THE INVENTION

Aim of the present invention is therefore to provide a climbing shoe that overcomes the drawbacks described above.

In compliance with these aims, according to the present invention there is provided a climbing shoe as disclosed in claim 1 and preferably, though not necessarily, in any one of the dependent claims.

BRIEF DESCRIPTION OF THE DRAWINGS

The present invention will now be described with reference to the accompanying drawings, which illustrate a non-limiting embodiment thereof, in which:

FIG. 2 is a perspective and partially exploded view of the climbing shoe shown in FIG. 1, with parts removed for the sake of clarity; whereas

PREFERRED EMBODIMENT OF THE INVENTION

Figure 1:
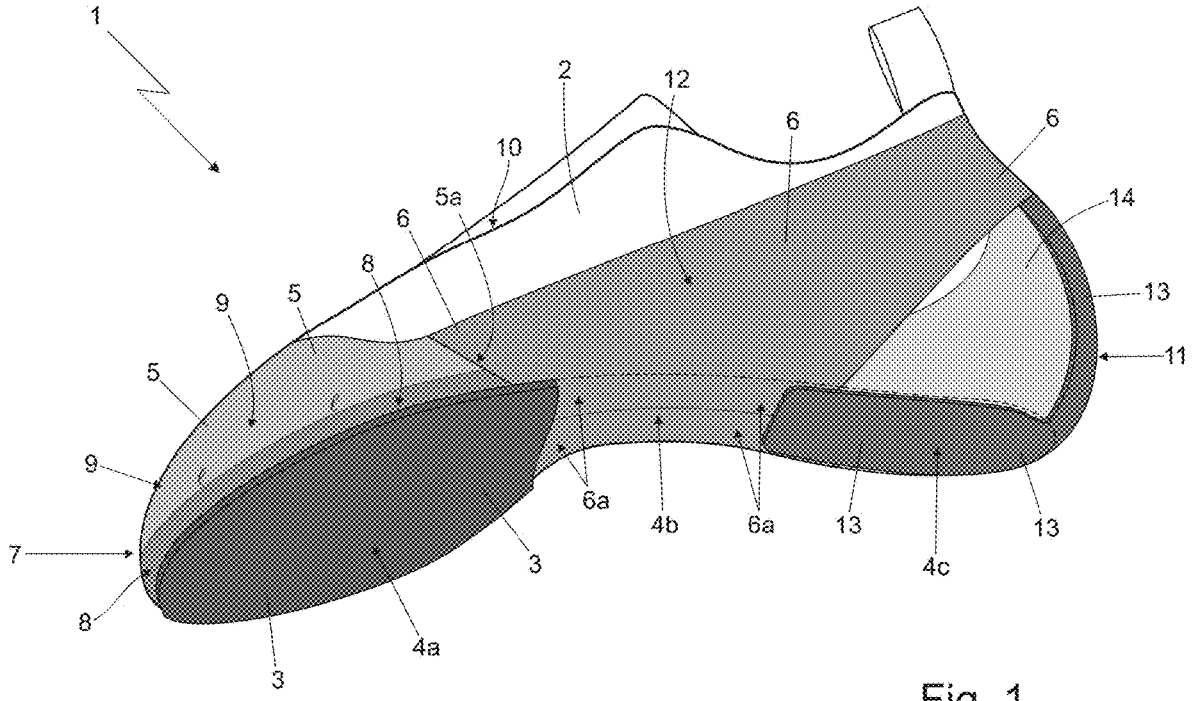
FIG. 1 is a perspective and schematic view of a climbing shoe realized according to the teachings of the present invention.
Figure 2:
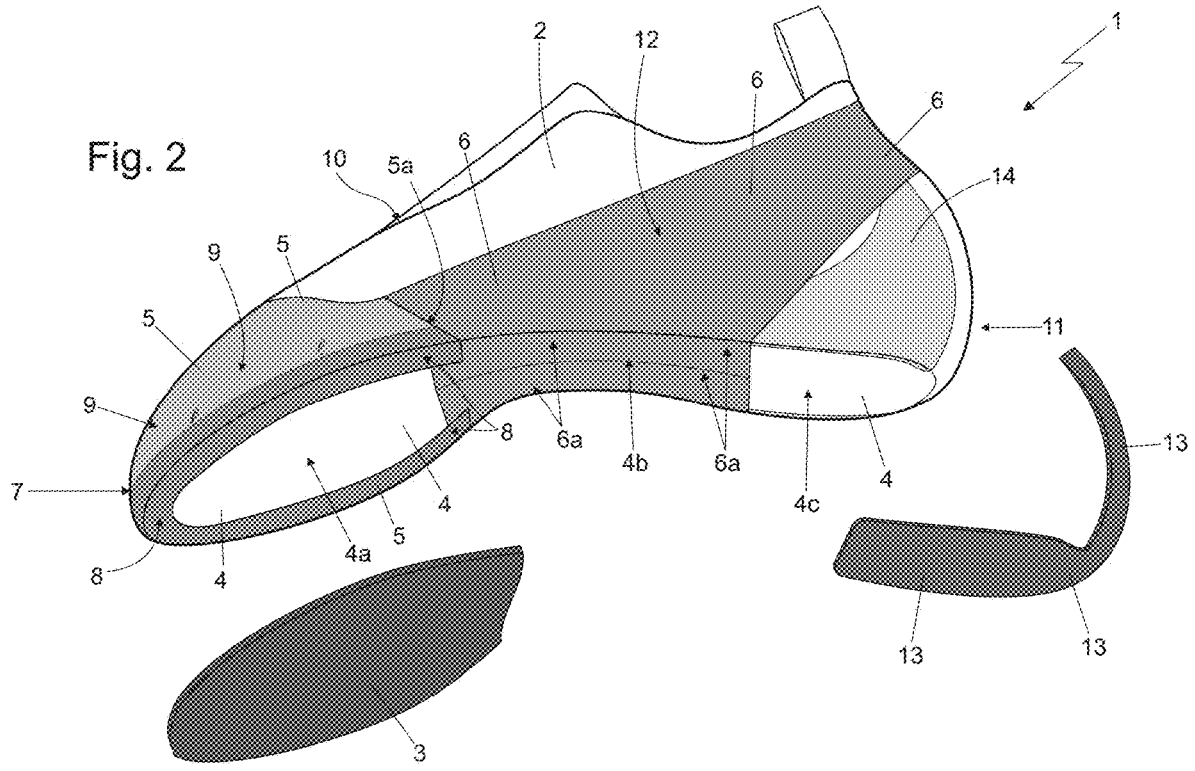
Figure 3:
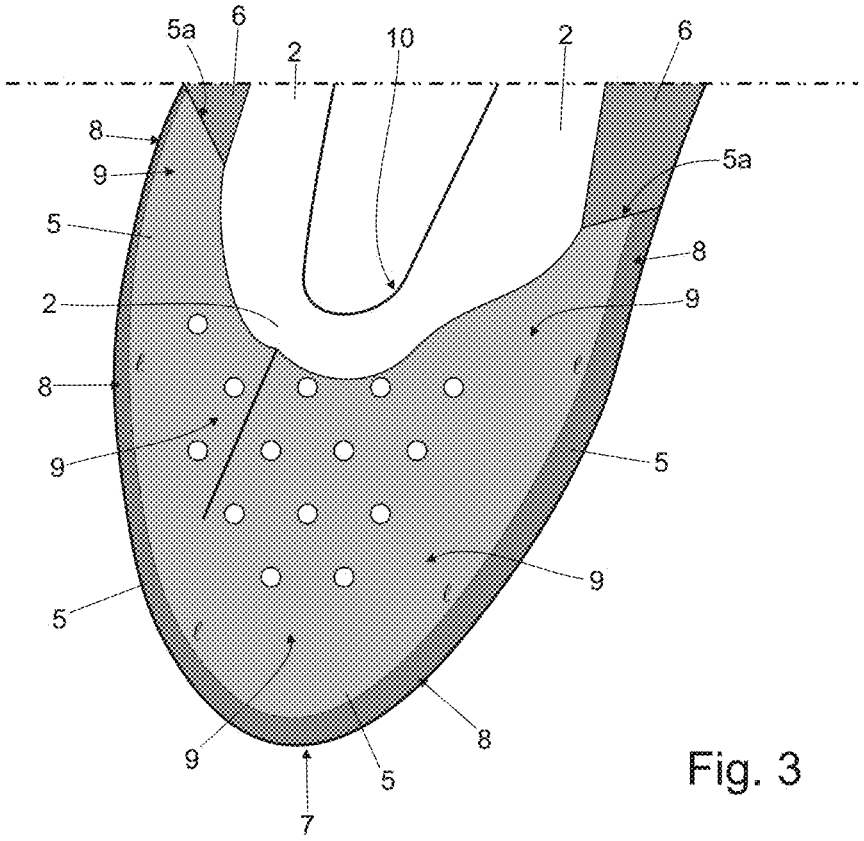
FIG. 3 is a perspective view of the upper part of the tip of the climbing shoe shown in FIG. 1.

With reference to FIGS. 1, 2 and 3, reference number 1 denotes as a whole a climbing shoe that may be particularly advantageously used for climbing on rock walls classified as grade IV or lower.

The climbing shoe 1 firstly comprises: a shoe-upper 2, preferably made of leather and/or fabric, which is substantially sock-shaped so as to accommodate and completely cover the foot of the user, including the sole of the foot; and a front sole 3 which is made of a soft and flexible polymeric material with a high friction coefficient and preferably also substantially inextensible, and which is firmly fixed to the bottom 4 of shoe-upper 2, preferably by gluing, so as to cover the front part of the bottom 4 of shoe-upper 2.

More in detail, the bottom 4 of shoe-upper 2, i.e. the part/sector of shoe-upper 2 that covers the sole of the user's foot, is longitudinally divided into a front or tarsus-phalangeal portion 4*a* that is immediately underneath the tarsus-phalangeal region of the sole of the user's foot; a central or plantar-arch portion 4*b* immediately underneath the plantar-arch region; and a rear or talus-calcaneal portion 4*c* immediately underneath the talus-calcaneal region of the sole of the user's foot.

The front sole 3 is preferably shaped/dimensioned so as to cover the tarsus-phalangeal portion 4*a* and optionally also part of the plantar-arch portion 4*b* of the bottom 4 of the shoe-upper 2.

Preferably, furthermore, the front sole 3 is made of a polymeric material having a hardness (UNI 4916) preferably less than 80 ShoreA and optionally ranging between 60 and 75 ShoreA.

With reference to FIGS. 1, 2 and 3, the climbing shoe 1 additionally comprises at least a front tensioning band 5 and a rear tensioning band 6, which are made of high-elasticity elastomeric material and are firmly fixed to the shoe-upper 2 preferably by gluing, so as to surround/enclose the user's foot.

Preferably, furthermore, the tensioning bands 5 and 6 are pre-tensioned in order to embrace and tighten the shoe-upper 2 firmly on the foot of the user, preferably while also stably bending/curving the tip of the user's foot downwards.

More in detail, the tensioning bands 5 and 6 are made of an elastomeric material with an elastic modulus (also known as Young's modulus) that is significantly lower than that of the polymeric material forming the sole 3.

With reference to FIGS. 1, 2 and 3, the front tensioning band 5 is substantially U-bent and is firmly fixed to the tip 7 of shoe-upper 2 preferably by gluing, so as to surround/embrace the front part of the bottom 4 of shoe-upper 2, while firmly joining to the front sole 3 preferably by gluing.

More in detail, the front tensioning band 5 is firmly fixed to the tip 7 of shoe-upper 2 so as to cover the band of the shoe-upper 2 that surrounds/flanks the tarsus-phalangeal portion 4*a* of the bottom 4 of shoe-upper 2, and preferably also extends/prolongs on the bottom 4 of shoe-upper 2 underneath the front sole 3.

In addition, the front tensioning band 5 has a ribbon-like monolithic structure, and is longitudinally divided into a lower ribbon-like portion 8 which is immediately adjacent/contiguous to the front sole 3, and into an upper ribbon-like portion 9 that flanks the lower ribbon-like portion 8 while remaining spaced from the edge of the front sole 3, and which, in addition, has a hardness (UNI 4916) lower than that of the lower ribbon-like portion 8.

Preferably, furthermore, the lower ribbon-like portion 8 of front tensioning band 5 has a hardness (UNI 4916) greater than or equal to the hardness (UNI 4916) of the front sole 3, whereas the upper ribbon-like portion 9 has a hardness (UNI 4916) lower than the hardness (UNI 4916) of the front sole 3.

More in detail, the front tensioning band 5 has a hardness (UNI 4916) that is preferably greater than or equal to 80 ShoreA inside the lower ribbon-like portion 8, and a hardness (UNI 4916) that is preferably less than or equal to 60 ShoreA inside the upper ribbon-like portion 9.

In other words, the front tensioning band 5 has a ribbon-like monolithic structure, and is divided along a longitudinal demarcation line l into two contiguous and complementary ribbon-like portions 8 and 9.

The lower ribbon-like portion 8 is immediately adjacent/contiguous to the front sole 3, and has a hardness (UNI 4916) greater than or equal to 80 ShoreA and optionally also greater than or equal to 90 ShoreA. Preferably, furthermore, the lower ribbon-like portion 8 of front tensioning band 5 additionally extends along the bottom 4 of shoe-upper 2, underneath the front sole 3.

The upper ribbon-like portion 9 of front tensioning band 5, on the other hand, flanks the lower ribbon-like portion 8 while remaining spaced from the edge of the front sole 3, and has a hardness (UNI 4916) less than or equal to 60 ShoreA and optionally ranging between 55 and 30 ShoreA.

In other words, the front tensioning band 5 is made of elastomeric material with a hardness (UNI 4916) greater than or equal to 80 ShoreA at the lower ribbon-like portion 8, and a hardness (UNI 4916) less than or equal to 60 ShoreA at the upper ribbon-like portion 9.

Preferably, the upper ribbon-like portion 9 and the lower ribbon-like portion 8 of front tensioning band 5 have a different colours to one another.

In the example shown, in particular, the front tensioning band 5 is preferably made of an elastomeric material with an elastic modulus 2-10 times lower than that of the polymeric material forming the front sole 3.

In addition, in the example shown the front tensioning band 5 is preferably made of an elastomeric material with a hardness (UNI 4916) greater than or equal to 90 ShoreA at the lower ribbon-like portion 8, and/or a hardness (UNI 4916) equal to approximately 40 ShoreA at the upper ribbon-like portion 9.

Additionally, the front tensioning band 5, or rather the upper ribbon-like portion 9 of front tensioning band 5, is preferably shaped so as to also extend along the upper part of the shoe-upper 2 preferably almost up to reach the top fitting opening 10 of the shoe-upper 2, so as to cover without interruptions also the anterosuperior part of shoe-upper 2.

The front part of the user's foot is thus inferiorly protected by the sole 3 and superiorly by the front tensioning band 5, or rather by the upper ribbon-like portion 9 of front tensioning band 5.

With reference to FIGS. 1, 2 and 3, on the other hand the rear tensioning band 6 surrounds the rear part of shoe-upper 2, preferably remaining above the heel portion 11 of shoe-upper 2, i.e. above the portion of shoe-upper 2 that covers the rear end of the calcaneus of the user's foot.

More in detail, the rear tensioning band 6 is substantially U-bent and is firmly fixed to the rear part of the shoe-upper 2 preferably by gluing, so as to cover the area of the shoe-upper 2 immediately above the heel portion 11, and then extend obliquely along the two inner and outer lateral sides 12 of shoe-upper 2 towards the bottom 4, up to reach and merge/join the front tensioning band 5 preferably by gluing.

Even in more detail, the rear tensioning band 6 is preferably shaped/structured so as to reach and merge/join the two ends 5*a* of the front tensioning band 5 along the two lateral sides 12 of the shoe-upper 2, close to the bottom 4 of shoe-upper 2 and near the border between the tarsus-phalangeal portion 4*a* and the plantar-arch portion 4*b* of bottom 4, i.e. near the border between the tarsus-phalangeal region and the plantar-arch region.

Preferably, the two ends 6*a* of rear tensioning band 6 furthermore extend/prolong along the bottom 4 of shoe-upper 2 one towards the other, so as to at least partially cover the plantar-arch portion 4*b* of bottom 4, and optionally also part of the tarsus-phalangeal portion 4*a* and/or of the talus-calcaneal portion 4*c* of the bottom 4 of shoe-upper 2.

Preferably, the two ends 6*a* of rear tensioning band 6 moreover extend along the bottom 4 of shoe-upper 2 underneath the front sole 3.

In the example shown, in particular, the two ends 6*a* of rear tensioning band 6 preferably extend along the bottom 4 of shoe-upper 2 so as to merge and firmly join one to the other, preferably more or less at the centreline of the plantar-arch portion 4*b* of bottom 4 and preferably so as to substantially completely cover the entire plantar-arch portion 4*b* of bottom 4.

More in detail, with reference to FIG. 2, in the example shown the two ends 6*a* of rear tensioning band 6 are preferably shaped so as to cover at least 50% of the plantar-arch portion 4*b* of the bottom 4 of shoe-upper 2, with the addition of a small part of the talus-calcaneal portion 4*c* and/or of the tarsus-phalangeal portion 4*a*.

In the same way as the front tensioning band 5, also the rear tensioning band 6 preferably has a ribbon-like monolithic structure, but is made of an elastomeric material preferably having a substantially uniform hardness (UNI 4916) over the entire body.

Preferably, the hardness (UNI 4916) of the elastomeric material forming the rear tensioning band 6 is moreover greater than or equal to 70 ShoreA and optionally also greater than or equal to 90 ShoreA.

In the example shown, in particular, likewise front tensioning band 5, the rear tensioning band 6 is preferably made of an elastomeric material having an elastic modulus 2-10 times lower than that of the polymeric material forming the front sole 3.

With reference to FIGS. 1 and 2, preferably the climbing shoe 1 additionally comprises a rear sole 13 discrete and separate from front sole 3 and which, similarly to front sole 3, is made of a soft and flexible, polymeric material with a high friction-coefficient and preferably substantially inextensible, and is firmly fixed to the bottom 4 of shoe-upper 2 preferably by gluing, so as to cover the rear part of the bottom 4 of shoe-upper 2 while remaining spaced from the front sole 3.

More in detail, the rear sole 13 is preferably shaped/dimensioned so as to cover the talus-calcaneal portion 4*c* of the bottom 4, optionally also extending over the plantar-arch portion 4*b* of the bottom 4 of shoe-upper 2 preferably while remaining locally above the two ends 6*a* of rear tensioning band 6.

Preferably, the rear sole 13 is moreover shaped so as to rise along the heel portion 11 of shoe-upper 2 while remaining substantially astride the midplane of the shoe, and preferably up to reach the rear tensioning band 6, so as to also cover the calcaneus of the user's foot.

In other words, the rear sole 13 is preferably L-bent so as to cover the talus-calcaneal portion 4*c* of the bottom 4 of shoe-upper 2, and then rise along the heel portion 11 of shoe-upper 2 while remaining substantially astride the mid-plane of the shoe.

Preferably, the rear sole 13 is furthermore made of a polymeric material having a hardness (UNI 4916) lower than that of the polymeric material forming the front sole 3.

In the example shown, in particular, rear sole 13 is preferably made of a polymeric material having a hardness (UNI 4916) preferably less than 60 ShoreA and optionally ranging between 45 and 55 ShoreA.

With reference to FIGS. 1 and 2, preferably the climbing shoe 1 is additionally provided with a pair of lateral protective inserts 14 preferably made of soft and flexible polymeric material, which are firmly fixed to the rear part of shoe-upper 2 on opposite sides of the rear sole 13, so as to cover the areas of the two lateral sides 12 of shoe-upper 2 that flank the calcaneus of the user's foot.

Preferably, each protective insert 14 is moreover shaped/structured so as to extend/prolong along the bottom 4 of shoe-upper 2 while remaining underneath the rear sole 13.

More in detail, in the example shown each protective insert 14 preferably consists of a preferably triangular-shaped, concave half-shell which is preferably made of a soft and flexible polymeric material with an elastic modulus lower than that of the polymeric material forming the front sole 3 and/or the rear sole 13, and preferably also with a hardness (UNI 4916) greater than that of the elastomeric material forming the rear tensioning band 6 and/or the rear sole 13.

Preferably, the polymeric material forming the protective insert 14 moreover has an elastic modulus greater than that of the elastomeric material forming the tensioning band 5 and/or 6.

In the example shown, in particular, the two lateral protective inserts 14 are made of a polymeric material with a hardness (UNI 4916) preferably ranging between 90 and 120 ShoreA.

Functioning of climbing shoe 1 is easy inferable from the above description, and therefore does not require further explanations.

The advantages deriving from the particular structure of front tensioning band 5 are remarkable.

Since it has two ribbon-like portions 8 and 9 with different hardness (UNI 4916), the front tensioning band 5 provides high abrasion resistance in proximity to the front sole 3 combined with an increased ability to adapt to the morphology of the tip of the user's foot, with all the advantages that this entails.

More in detail, being softer than usual, the upper ribbon-like portion 9 of front tensioning band 5 enables the tip of the shoe to adapt better to the morphology of the tip of the user's foot, while the lower ribbon-like portion 8 still ensures adequate abrasion resistance and good support for the user's foot in the phalangeal area, thus increasing the overall performance of the shoe.

It is finally clear that modifications and variations can be made to the climbing shoe 1 described and illustrated above without thereby departing from the scope of the present invention.

For example, in a different embodiment the rear sole 13 could be made as a single piece with the front sole 3 so as to form a large monolithic sole that covers substantially the whole bottom 4 of shoe-upper 2.

The invention claimed is:

1. A climbing shoe comprising:

a shoe upper shaped so as to accommodate and cover substantially an entire foot of a user;

a front sole made of polymeric material, which is fixed to a bottom of the shoe upper so as to cover at least a front part of the bottom of said shoe upper; and at least a front tensioning band made of elastomeric material, which is substantially U-bent and is fixed to a tip of the shoe upper so as to surround and/or enclose the front part of the bottom of the shoe upper, joining the front sole;

wherein the front tensioning band has a ribbon-like monolithic structure and is longitudinally divided into a lower ribbon-like portion which is immediately adjacent and/or contiguous to the front sole, and into an upper ribbon-like portion which flanks the lower ribbon-like portion while remaining spaced from an edge of the front sole, and which has a hardness lower than that of the lower ribbon-like portion.

2. The climbing shoe according to claim 1, wherein the upper ribbon-like portion of the front tensioning band has a hardness less than or equal to 60 ShoreA.

3. The climbing shoe according to claim 1, wherein the lower ribbon-like portion of the front tensioning band has a hardness greater than or equal to 80 ShoreA.

4. The climbing shoe according to claim 1, wherein the upper ribbon-like portion of the front tensioning band has a hardness ranging between 30 and 55 ShoreA.

5. The climbing shoe according to claim 1, wherein the upper ribbon-like portion of the front tensioning band extends over a top part of the shoe upper towards a top fitting opening of the shoe upper, so as to cover an upper-front part of the shoe upper without any interruption.

6. The climbing shoe according to claim 1, wherein the front tensioning band is made of an elastomeric material having an elastic modulus 2-10 times lower than that of the polymeric material forming the front sole.

7. The climbing shoe according to claim 1, wherein the shoe comprises a rear tensioning band made of elastomeric material, which is substantially U-bent and is fixed to a rear part of the shoe upper so as to cover an area of the shoe upper immediately above a heel portion of the shoe upper, and then to extend obliquely along two lateral sides of the shoe upper towards the bottom up to reach and join the front tensioning band.

8. The climbing shoe according to claim 7, wherein the rear tensioning band joins two ends of the front tensioning band on the two lateral sides of the shoe upper, close to a boundary between a tarsal-phalangeal portion and a plantar-arch portion of the bottom of the shoe upper.

9. The climbing shoe according to claim 7, wherein two ends of the rear tensioning band extend and/or prolong on the bottom of the shoe upper one towards the other, so as to at least partially cover a plantar-arch portion of the bottom of the shoe upper.

10. The climbing shoe according to claim 7, wherein the rear tensioning band is made of an elastomeric material having an elastic modulus 2-10 times lower than that of the polymeric material forming the front sole.

11. The climbing shoe according to claim 1, wherein the shoe additionally comprises a rear sole made of polymeric material, which is discrete from the front sole and is fixed to the bottom of the shoe upper so as to cover at least a rear part of the bottom of the shoe upper while remaining spaced from the front sole.

12. The climbing shoe according to claim 11, wherein the shoe comprises a rear tensioning band made of elastomeric material, which is substantially U-bent and is fixed to a rear part of the shoe upper so as to cover an area of the shoe upper immediately above a heel portion of the shoe upper, and then to extend obliquely along two lateral sides of the shoe upper towards the bottom up to reach and join the front tensioning band; and wherein the rear sole rises along the heel portion of the shoe upper, up to reach the rear tensioning band.

13. The climbing shoe according to claim 1, wherein the front sole covers substantially an entire bottom of the shoe upper.

14. The climbing shoe according to claim 13, wherein the shoe additionally comprises a rear tensioning band made of elastomeric material, which is substantially U-bent and is fixed to a rear part of the shoe upper so as to cover an area of the shoe upper immediately above a heel portion of the shoe upper, and then to extend obliquely along two lateral sides of the shoe upper towards the bottom up to reach and join the front tensioning band; and wherein the rear sole rises along the heel portion of the shoe upper, up to reach the rear tensioning band.

* * * * *